US007175675B2

(12) United States Patent
Pyles et al.

(10) Patent No.: US 7,175,675 B2
(45) **Date of Patent: *Feb. 13, 2007**

(54) METHOD OF DYEING A PLASTIC ARTICLE

(75) Inventors: Robert A. Pyles, Bethel Park, PA (US); Rick L. Archey, Pleasant Hills, PA (US); David M. Derikart, Tarentum, PA (US)

(73) Assignee: Bayer MaterialScience LLC, Pittsburgh, PA (US)

( * ) Notice: Subject to any disclaimer, the term of this patent is extended or adjusted under 35 U.S.C. 154(b) by 93 days.

This patent is subject to a terminal disclaimer.

(21) Appl. No.: 10/733,111

(22) Filed: Dec. 11, 2003

(65) Prior Publication Data

US 2005/0125916 A1 Jun. 16, 2005

(51) Int. Cl.
*D06P 5/00* (2006.01)

(52) U.S. Cl. ..... 8/506; 8/509; 8/510; 8/514; 8/515; 8/516; 8/611

(58) Field of Classification Search ..... 8/506–516
See application file for complete search history.

(56) References Cited

U.S. PATENT DOCUMENTS

| | | | | |
|---|---|---|---|---|
| 3,514,246 | A | 5/1970 | Bianco et al. | 8/4 |
| 3,532,454 | A | 10/1970 | Fuhr et al. | 8/4 |
| 3,630,664 | A | 12/1971 | Nentwig et al. | 8/173 |
| 3,953,167 | A | 4/1976 | Minemura et al. | 8/175 |
| 4,076,496 | A | 2/1978 | Hamano | 8/4 |
| 4,310,330 | A | 1/1982 | Funaki et al. | 8/506 |
| 4,465,728 | A | 8/1984 | Haigh et al. | 428/156 |
| 4,812,142 | A | 3/1989 | Brodmann | 8/512 |
| 5,205,862 | A | 4/1993 | Kiyomoto et al. | 106/22 R |
| 5,258,444 | A | 11/1993 | Zezinka et al. | 524/507 |
| 5,453,100 | A | 9/1995 | Sieloff | 8/479 |
| 6,141,027 | A | 10/2000 | Akutsu et al. | 347/163 |
| 6,454,845 | B1 | 9/2002 | Shawcross et al. | 106/31.49 |
| 6,464,733 | B2 | 10/2002 | Ryser | 8/444 |
| 6,733,543 | B2 | 5/2004 | Pyles et al. | 8/506 |
| 6,749,646 | B2 | 6/2004 | Pyles et al. | 8/506 |
| 2002/0040511 | A1 | 4/2002 | Ryser | 8/506 |

FOREIGN PATENT DOCUMENTS

| | | |
|---|---|---|
| JP | 51-59254 | 5/1976 |
| JP | 55-17156 | 5/1980 |
| JP | 56-31085 | 3/1981 |
| JP | 04-057977 | 2/1992 |
| JP | 2000-248476 | 9/2000 |
| WO | 00/14325 | 3/2000 |

*Primary Examiner*—Lorna M. Douyon
*Assistant Examiner*—Tri Nguyen
(74) *Attorney, Agent, or Firm*—Joseph C. Gil; Aron Preis

(57) ABSTRACT

In the method of the present invention a plastic article (e.g., a molded article of thermoplastic polycarbonate) is immersed at least partially in a dye bath which includes one or more dyes, water, at least one carrier, and at least one diol. The dye bath contains: (i) at least one dye (e.g., a static and/or photochromic dye); (ii) water; (iii) at least one carrier represented by the following general formula I, $$R—O—(CH_2)_n—OHI$$

wherein R is a radical selected from linear or branched $C_1$–$C_{18}$ alkyl, benzyl, benzoyl and phenyl, and n is 2 or 3; and (iv) a diol selected from at least one of linear or branched $C_2$–$C_{20}$ aliphatic diols, poly($C_2$–$C_4$ alkylene glycol), cycloaliphatic diols having from 5 to 8 carbon atoms in the cyclic ring, monocyclic aromatic diols, bisphenols and hydrogenated bisphenols. In an embodiment of the present invention, the carrier is ethyleneglycol butyl ether, and the diol is diethylene glycol. The present invention also relates to a method of separating the dye from the water, carrier and diol components of the dye bath, by contacting the dye bath with particulate activated carbon.

21 Claims, 2 Drawing Sheets

METHOD OF DYEING A PLASTIC ARTICLE

FIELD OF THE INVENTION

The present invention relates to a method of dyeing a plastic article. The plastic article (e.g., a molded article of thermoplastic polycarbonate) is immersed at least partially in a dye bath which includes one or more dyes, water, at least one carrier (e.g., ethyleneglycol butyl ether), and a diol (e.g., diethylene glycol).

BACKGROUND OF THE INVENTION

Colored plastic articles can be prepared by means of incorporating (e.g., by means of compounding) pigments and/or dyes directly into the polymeric materials from which the articles are prepared. Such direct incorporation methods result in the colorant being dispersed substantially throughout the molded article. Direct incorporation methods are not particularly well suited for the preparation of molded articles that are only slightly colored or tinted (e.g., less than opaque), such as in the case of sunshade lenses. It is typically difficult to adequately and sufficiently disperse the small amounts of colorant required to prepare slightly colored or tinted plastic articles, by means of direct incorporation methods.

While master-batches of dye and resin can be used to better control the amount of dye incorporated during compounding and/or extrusion processes, the preparation of the master-batch requires additional steps. In addition, the resin of the master-batch will be exposed to at least two heat cycles (one during the preparation of the master-batch, and another during preparation of the dyed molded article), which can result in a final molded article having degraded physical properties.

The preparation of colored plastic articles by means of applying a dye composition to the surface of the plastic article is generally known. Such dyeing methods are more suited to the preparation of slightly colored or tinted molded articles, as only small and controlled amounts of colorant are incorporated into the surface thereof. The dye compositions may be aqueous or non-aqueous.

In light of environmental concerns related to the use of organic solvents, more recently there has been increased emphasis towards the development of dyeing methods that make use of aqueous dye compositions. Methods of dyeing plastic articles that make use of aqueous dye compositions typically suffer from disadvantages that include, for example, non-uniform and/or inadequate dyeing of the article, and an inconsistent degree of dyeing between different batches of the same plastic articles.

It would be desirable to develop new methods of dyeing plastic articles that make use of aqueous dye compositions, and that result in the formation of uniformly and sufficiently dyed articles. In addition, it would be desirable that such new methods also provide consistent degrees of dyeing over time.

SUMMARY OF THE INVENTION

In accordance with the present invention, there is provided a method of dyeing a plastic article comprising:

(a) providing a plastic article comprising at least one polymer selected from thermoplastic polymer and thermoset polymer;

(b) immersing at least a portion of said molded article in a dye bath comprising, (i) at least one dye, (ii) water, (iii) at least one carrier represented by the following general formula I, $$R—O—(CH_2)_n—OH \quad \text{I}$$

wherein R is a radical selected from linear or branched $C_1$–$C_{18}$ alkyl, benzyl, benzoyl and phenyl, and n is 2 or 3, and (iv) a diol selected from at least one of linear or branched $C_2$–$C_{20}$ aliphatic diols, poly($C_2$–$C_4$ alkylene glycol), cycloaliphatic diols having from 5 to 8 carbon atoms in the cyclic ring, monocyclic aromatic diols, bisphenols and hydrogenated bisphenols;

(c) retaining said portion of said molded article in said bath for a period of time at least sufficient to form a dyed molded article; and (d) removing said dyed molded article from said bath.

Other than in the operating examples, or where otherwise indicated, all numbers expressing quantities of ingredients, reaction conditions, and so forth used in the specification and claims are to be understood as modified in all instances by the term "about."

DETAILED DESCRIPTION OF THE INVENTION

Figure 1:
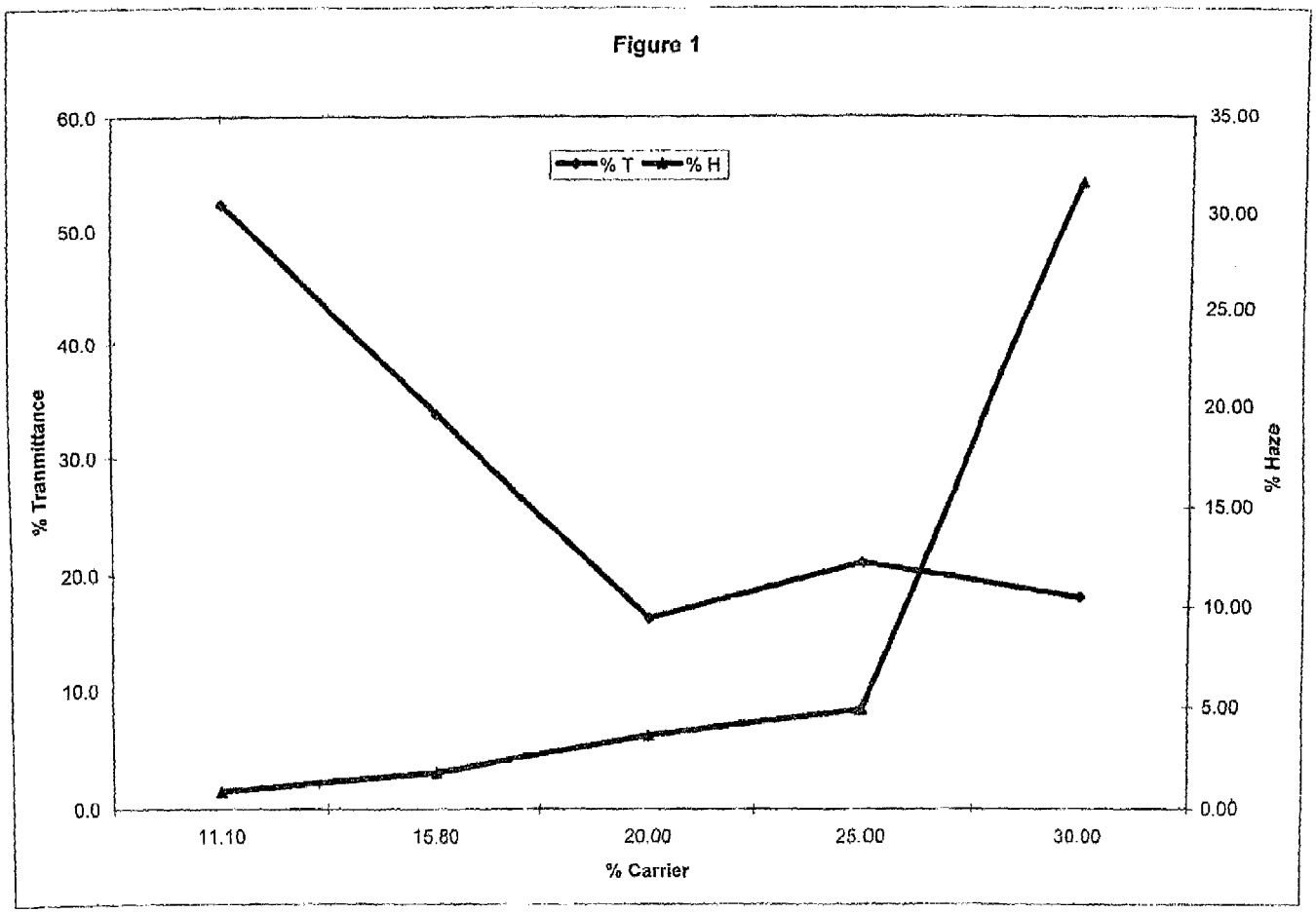
FIG. 1 is a graphical representation of a plot of percent light transmission (% T) and percent haze (% H) of dyed plastic articles as a function of the amount of carrier present in the dye bath.

The dye bath used in the method of the present invention includes at least one carrier according to formula I, as described previously herein. Linear or branched alkyls from which R of formula I may be selected include, but are not limited to, methyl, ethyl, propyl, butyl, pentyl, hexyl, heptyl, octyl, nonyl, decyl, undecyl, dodecyl, tridecyl, tetradecyl, pentadecyl, hexadecyl, heptadecyl and octadecyl, and structural isomers thereof (e.g., iso-propyl, i-butyl, t-butyl, etc.).

With further reference to formula I, R may also be selected from benzyl, benzoyl and phenyl groups, each of which may independently and optionally be substituted with 1 to 5 groups selected from halo groups (e.g., chloro, bromo and fluoro), linear or branched $C_1$–$C_9$ alkyl groups (e.g., methyl, ethyl, propyl, butyl, pentyl, hexyl, heptyl, octyl and nonyl,), and aromatic groups (e.g., phenyl).

In an embodiment of the present invention, regarding formula I, n is 2 and R is selected from n-butyl, i-butyl and t-butyl. In a particularly preferred embodiment of the present invention, n is 2, and R is n-butyl.

The carrier is typically present in the dye bath in an amount of less than or equal to 30 percent by weight, preferably less than or equal to 25 percent by weight, and more preferably less than or equal to 20 percent by weight. The carrier is also typically present in the dye bath in an amount of at least 10 percent by weight, preferably at least 15 percent by weight, and more preferably at least 17 percent by weight. The carrier may be present in the bath in an amount ranging between any combination of these upper and lower values, inclusive of the values thereof. For example, the carrier may be present in the dye bath in an amount typically from 10 to 30 percent by weight, more typically from 15 to 25 percent by weight, and further typically in an amount of from 17 to 20 percent by weight. The percent weights being based on the total weight of the dye bath, in each case.

The dye bath also further includes a diol selected from at least one of linear or branched $C_2$–$C_{20}$ aliphatic diols, poly($C_2$–$C_4$ alkylene glycol), cycloaliphatic diols having from 5 to 8 carbon atoms in the cyclic ring, monocyclic aromatic diols, bisphenols and hydrogenated bisphenols. Examples of linear or branched $C_2$–$C_{20}$ aliphatic diols include, but are not limited to, ethylene glycol, propylene glycol, 1,3-propane diol, 1,2- and 2,3-butane diol, pentane diols, hexane diols, heptane diols, octane diols, nonane diols, decane diols, undecane diols, dodecane diols, tridecane diols, tetradecane diols, pendadecane diols, hexadecane diols, hetadecane diols, octadecane diols, nonadecane diols and icosane diols.

Examples of poly($C_2$–$C_4$)alkylene glycols from which the diol (iv) may be selected include, but are not limited to, di-, tri-, tetra-, penta- and higher ethylene glycols, di-, tri-, tetra-, penta- and higher propylene glycols, and di-, tri-, tetra-, penta- and higher butylene glycols. Cycloaliphatic diols having from 5 to 8 carbon atoms that may be used as diol (iv) include, but are not limited to, cyclopentane diol, cyclohexane diol, cyclohexane dimethanol, cycloheptane diol and cyclooctane diol. Examples of monocyclic aromatic diols that may be used as diol (iv) include but are not limited to, benzene diol, e.g., 1,2-dihydroxy benzene and 1,3-dihydroxy benzene; $C_1$–$C_4$ alkyl substituted benzene diol, e.g., 4-tert-butyl-benzene-1,2-diol, 4-methyl-benzene-1,2-diol, 3-tert-butyl-5-methyl-benzene-1,2-diol and 3,4,5,6-tetramethyl-benzene-1,2-diol; halo substituted benzene diol, e.g., 3,5-dichlorobenzene-1,2-diol, 3,4,5,6-tetrabromo-benzene-1,2-diol and 3,4,5-trichloro-benzene-1,2-diol; and $C_1$–$C_4$ alkyl and halo substituted benzene diol, e.g., 3-bromo-5-tert-butyl-benzene-1,2-diol, 3,6-dichloro-4-methyl-benzene-1,2-diol, 3,-bromo-4,5-dimethyl-benzene-1,2-diol and 3-chloro-4,6-di-tert-butyl-benzene-1,2-diol.

Bisphenols and hydrogenated bisphenols that may be used as diol (iv) may be represented by the following general formula II, Formula II

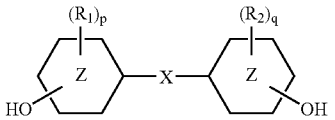

In formula II: $R_1$ and $R_2$ are each selected independently from each other and independently for each p and q from $C_1$–$C_4$ alkyl (e.g., methyl, ethyl, n-propyl, iso-propyl, n-butyl, sec-butyl and tert-butyl), chlorine and bromine; p and q are each independently an integer from 0 to 4; and —X— is a divalent linking group selected from —O—, —S—, —S($O_2$)—, —C(O)—, —$CH_2$—, —CH═CH—, —C($CH_3$)$_2$—, and —C($CH_3$)($C_6H_5$)—; and

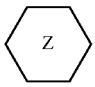

represents a benzene ring or a cyclohexane ring. An example of a bisphenol that may be used as diol (iv) is 4,4'-isopropylidenebisphenol (i.e., bisphenol A). An example of a hydrogenated bisphenol that may be used as diol (iv) is 4,4'-isopropylidenebiscyclohexanol.

In a preferred embodiment of the present invention, diol (iv) is a poly($C_2$–$C_4$ alkylene glycol) selected from diethylene glycol, triethylene glycol, tetraethylene glycol, pentaethylene glycol and mixtures thereof. Particularly preferred diols are ethylene glycol and diethylene glycol.

The diol is typically present in the dye bath in an amount of less than or equal to 20 percent by weight, preferably less than or equal to 15 percent by weight, and more preferably less than or equal to 12 percent by weight. The diol is also typically present in the dye bath in an amount of at least 1 percent by weight, preferably at least 5 percent by weight, and more preferably at least 10 percent by weight. The diol may be present in the bath in an amount ranging between any combination of these upper and lower values, inclusive of the values thereof. For example, the diol may be present in the dye bath in an amount typically from 1 to 20 percent by weight, more typically from 5 to 15 percent by weight, and further typically in an amount of from 10 to 12 percent by weight. The percent weights being based on the total weight of the dye bath, in each case.

The dye that is present in the dye bath may be selected from static dyes, photochromic dyes and combinations thereof. As used herein and in the claims, the term "static dyes" means a dye that does not substantially change color upon exposure to (or being shielded from) ultraviolet (UV) light. The term "photochromic dyes" as used herein and the claims means dyes that reversibly change color upon exposure to UV light, as is known to the skilled artisan. Typically, upon exposure to a particular wavelength of UV light, a photochromic dye will be converted into an open or activated form which is colored (within a particular portion of the visible spectrum). Upon removal of the UV light source, the open/activated photochromic dye returns to a closed/inactivated from which is not colored, or which is at least less colored than the activated form.

Static dyes that may be included in the dye bath include, for example, fabric dyes and disperse dyes as well as dyes that are known in the art as being suitable for tinting plastic articles, such as thermoplastic polycarbonate articles. Examples of suitable disperse dyes include, but are not limited to, Disperse Blue #3, Disperse Blue #14, Disperse Yellow #3, Disperse Red #13 and Disperse Red #17. The classification and designation of the static dyes are recited herein in accordance with "The Colour Index", 3$^{rd}$ edition published jointly by the Society of Dyes and Colors and the American Association of Textile Chemists and Colorists (1971), which is incorporated herein by reference. Dyestuffs can generally be used either as a sole dye constituent or as a component of a dye mixture depending upon the color desired. Thus, the term static dye as used herein includes mixtures of static dyes.

The static dye class known as Direct Dyes is useful in the practice of the present invention. Direct Dye examples include, but are not limited to, Solvent Blue 35, Solvent Green 3 and Acridine Orange Base. However, it has been observed that Direct Dyes, typically do not color (tint/dye) the plastic article as intensely as do Disperse Dyes (which have been described previously herein).

Further suitable static dyes include, for example, water-insoluble azo, diphenylamine and anthraquinone compounds. Especially suitable examples include acetate dyes, dispersed acetate dyes, dispersion dyes and dispersol dyes, such as are disclosed in Colour Index, 3rd edition, vol. 2, The Society of Dyers and Colourists, 1971, pp. 2479 and pp. 2187–2743, respectively all incorporated herein by reference. Preferred dispersed dyes include Dystar's Palanil Blue E-R150 (anthraquinone/Disperse Blue) and DIANIX Orange E-3RN (azo dye/Cl Disperse Orange 25). It has been observed that phenol red and 4-phenylazophenol do not provide a desirable level of dying when the plastic article is thermoplastic polycarbonate, in the present process.

Static dyes known as direct dyes and those referred to as acid dyes have been observed to provide a less than desirable level of tinting when the plastic article is thermoplastic polycarbonate, in the practice of the present invention. However, acid dyes have been observed to be effective with nylon.

Another class of suitable static dyes that may be used in the method of the present invention include non-migratory static dyes (i.e., static dyes that have been chemically modified to minimize or eliminate their migration out of plastic articles into which they have been incorporated). A particular class of non-migratory static dyes may be represented by the following formula III, $$R_5\text{-(polymeric constituent-Y)}_t \qquad \text{III}$$

In formula III: $R_5$ represents an organic dyestuff radical (or chromophore radical); the polymeric constituent is selected independently for each (t) from homopolymers, copolymers and block-copolymers of poly($C_2$–$C_4$ alkylene oxides), e.g., homopolymers of polyethylene oxide and polypropylene oxide, poly(ethylene oxide—propylene oxide) copolymers, and di- or higher block copolymers of ethylene oxide and propylene oxide; (t) may be an integer from 1 to 6; and (Y) is selected independently for each (t) from hydroxyl, primary amine, secondary amine and thiol groups. The polymeric constituent may have a molecular weight of from, for example, 44 to 1500. Dyestuff radicals from which (Y) may be selected include, but are not limited to, nitroso, nitro, azo (e.g., monoazo, diazo and triazo), diarylmethane, triarylmethane, xanthene, acridene, methine, thiazole, indamine, azine, oxazine and anthraquinone dyestuff radicals. Non-migratory static dyes represented by formula III are described in further detail in U.S. Pat. Nos. 4,284,729; 4,640,690; and 4,812,141.

Non-migratory static dyes have been found to be useful when dyeing plastic articles by means of imbibition or diffusion in accordance with the method of the present invention (e.g., by dipping). When incorporated into the plastic article by means of imbibition, excess non-migratory static dye can be washed off of the plastic article, with a minimum of imbibed non-migratory static dye being leached from the plastic article. Non-migratory static dyes (e.g., as represented by formula III) have been found to be particularly useful in the method of the present invention when dyeing (e.g., by dipping) plastic articles fabricated from thermoplastic polyurethane.

Photochromic dyes that may be used in the present method include those known to the skilled artisan. Classes of suitable photochromic dyes include, but are not limited to: spiro(indoline)naphthoxazines and spiro(indoline)benoxazines (e.g., as described in U.S. Pat. No. 4,818,096); and chromenes, such as benzopyrans and naphthopyrans (e.g., as described in U.S. Pat. No. 5,274,132), and benzopyrans having substituents at the 2-position of the pyran ring and an optionally substituted heterocyclic ring, such as a benzothieno or benzofurano ring fused to the benzene portion of the benzopyran (e.g., as described in U.S. Pat. No. 5,429,774). Further classes of photochromic dyes include, for example, fulgides and fulgimides, such as 3-furyl and 3-thienyl fulgies and fulgimides (e.g., as described in U.S. Pat. No. 4,931,220). The pertinent disclosures of the cited patents with regard to photochromic dyes is incorporated herein by reference.

Photochromic dyes or mixtures thereof may be used alone or in combination with one or more static dyes in the method of the present invention. Typically, the imbibition of photochromic dyes into thermoplastic articles, such as thermoplastic polycarbonate articles, results in a dyed plastic article that does not readily change color upon exposure to or shielding from UV light. While not intending to be bound by any theory, it is believed based on the information at hand, that the photochromic dyes become trapped in either an open or closed form within the thermoplastic polymer matrix. The imbibition of photochromic dyes into plastic articles fabricated from thermoset polymers, such as thermoset polycarbonates or thermoset polyurethanes, typically results in the formation of a dyed plastic article having photochromic properties.

The amount of dye present in the dye bath may vary widely. Typically the dye is present in the dye bath in an amount sufficient to result in the formation of a dyed plastic article having a colored effect and/or a photochromic effect that is discernible to the naked eye, e.g., upon exposure to UV light in the case of photochromic dyes.

The amount of dye that is actually present in the dye bath will depend on the solubility of the dye within the mixture of water, carrier and diol. The solubility of the dye within the bath will also be affected by the temperature of the bath. In those instances where the dye is not fully soluble in the bath, the dye bath is deemed to contain a saturated level of dye. By adding an amount of dye that is in excess of the saturation level of dye in the bath (e.g., to a bag filter through which the dye bath is continually passed) the level of dye in the bath can be maintained at the saturation level during dyeing operations. The level (e.g., the saturation level) of dye in the bath can be determined periodically or continuously by, for example, thermogravimetric analysis or spectrophotometric analysis.

Typically the dye is present in the dye bath in an amount of less than or equal to 15 percent by weight, more typically less than or equal to 5 percent by weight, further typically less than equal to 1 percent by weight, and still further typically less than 0.5 percent by weight. The dye is also typically present in the dye bath in an amount of at least 0.001 percent by weight, preferably at least 0.005 percent by weight, and more preferably at least 0.01 percent by weight. The dye may be present in the bath in an amount ranging between any combination of these upper and lower values, inclusive of the values thereof. For example, the dye may be present in the dye bath in an amount typically from 0.001 to 15 percent by weight, more typically from 0.005 to 5 percent by weight, further typically in an amount of from 0.01 to 1 percent by weight, and still further typically in an amount of from 0.01 to 0.5 percent by weight. In an embodiment, the dye is present in the dye bath in an amount of 0.03 percent by weight. The percent weights being based on the total weight of the dye bath, in each case.

In a preferred embodiment of the present invention, the dye bath contains: 0.001 to 0.5 percent by weight of said dye; 65 to 75 percent by weight of water; 15 to 25 percent by weight of said carrier; and 1 to 15 percent by weight of said diol. The percent weights being based, in each case, on the total weight of the dye bath.

Water is typically present in the dye bath in an amount of less than or equal to 85 percent by weight, preferably less than or equal to 80 percent by weight, and more preferably less than or equal to 75 percent by weight. Water is also typically present in the dye bath in an amount of at least 50 or 51 percent by weight, preferably at least 60 percent by weight, and more preferably at least 65 percent by weight. Water may be present in the bath in an amount ranging between any combination of these upper and lower values, inclusive of the values thereof. For example, water may be present in the dye bath in an amount typically from 50 (or 51) to 85 percent by weight, more typically from 60 to 87 percent by weight, and further typically in an amount of from 65 to 75 percent by weight. The percent weights being based on the total weight of the dye bath, in each case. The water used is preferably deionized water or distilled water.

In an embodiment of the present invention, the dye bath further includes a surfactant (or emulsifier), which is different from each of the carrier and the diol. Suitable surfactants in the present invention are readily dispersible upon being poured into water, and then form a milky emulsion upon agitation thereof. The surfactant may be selected from at least one of: anionic surfactants; amphoteric surfactants; and a non-ionic surfactant selected from at least one of poly ($C_2$–$C_4$ alkoxylated) $C_{14}$–$C_{18}$ unsaturated fatty acids, poly ($C_2$–$C_4$ alkoxylated)phenol and poly($C_2$–$C_4$ alkoxylated) $C_1$–$C_9$ alkyl substituted phenol.

Examples of anionic surfactants that may be used in the present invention include, for example, amine salts or alkali salts of carboxylic, sulfamic or phosphoric acids, for example sodium lauryl sulfate, ammonium lauryl sulfate, lignosulfonic acid salts, ethylene diamine tetra acetic acid (EDTA) sodium salts and acid salts of amines such as laurylamine hydrochloride or poly(oxy-1,2-ethanediyl),alpha.-sulfo-omega-hydroxy ether with phenol 1-(methylphenyl)ethyl derivative ammonium salts Amphoteric surfactants that may be present in the dye bath include, for example: lauryl sulfobetaine; dihydroxy ethylalkyl betaine; amido betaine based on coconut acids; disodium N-lauryl amino propionate; or the sodium salts of dicarboxylic acid coconut derivatives.

Examples of poly($C_2$–$C_4$ alkoxylated) $C_{14}$–$C_{18}$ unsaturated fatty acids include, ethoxylated, propoxylated and/or butoxylated tetradecenyl carboxylic acid. Examples of poly ($C_2$–$C_4$ alkoxylated)phenols include ethoxylated, propoxylated and/or butoxylated phenol. Examples of poly($C_2$–$C_4$ alkoxylated) $C_1$–$C_9$ alkyl substituted phenols, include, octylphenoxypolyethyleneoxyethanol and poly(oxy-1,2-ethanediyl), alpha-phenyl-omega-hydroxy, styrenated.

The optional surfactant (emulsifier) may be used in an amount less than or equal to 5 percent by weight. Preferably the optional surfactant is present in the dye bath in an amount of 0.5 to 5 percent by weight, and more preferably in an amount of 1 to 4 percent by weight. The percent weights, in each case, being based on the weight of the dye bath.

The dye bath may further optionally include a performance enhancing additive selected from at least one of UV stabilizers, optical brighteners, mold release agents, antistatic agents, thermal stabilizers, IR absorbers and antimicrobial agents (substances or compounds). Inclusion of one or more of these optional performance enhancing additives in the dye bath serves to improve the physical performance/properties of the dyed plastic article. In addition to the dye, the optional additives also diffuse, impregnate or otherwise are imbibed into the bulk of the plastic article while it is immersed,in the dye bath. For example, including UV stabilizers in the dye bath results in a dyed plastic article having improved UV resistance. Mold release agents would be more advantageously included in the dye bath when the plastic article is selected from thermoplastic pellets and/or thermoplastic strands, from which a molded article would later be prepared, as will be discussed further herein. The optional performance enhancing additives may be selected from those that are known for use in preparing thermoplastic and thermoset molded plastic articles.

Classes of UV (ultraviolet) stabilizers (or absorbers) that may be used in the dye bath of the present invention include, but are not limited to salicylic acid UV absorbers, benzophenone UV absorbers, benzotriazole UV absorbers, cyanoacrylate UV absorbers, and mixtures thereof. More specific examples of benzotriazole UV absorbers include but are not limited to: 2-(2'-hydroxy-5'methylphenyl)-benzotriazole (commercially available as Tinuvin® from Ciba, Tarrytown, N.Y.); 2-(3'-5'-di-tert-butyl-2'-hydroxyphenyl)-5-chlorobenzotriazole (commercially available as Tinuvin® 327 from Ciba); 2(2'-hydroxy-3'-5'-di-tert-amylphenyl)benzotriazole (commercially available as Tinuvin® 328 from Ciba); benzenepropanoic acid, 3-(2H-benzotriazol-2-yl)-5-(1,1-dimethyl ethyl)-4-hydroxy-, $C_{7-9}$ branched alkyl esters (commercially available as Tinuvin® 384 from Ciba); 2-(3',5'-bis(1-methyl-1-phenylethyl)-2'-hydroxyphenyl) benzotriazole (commercially available as Tinuvin® 900 from Ciba); 2-[2-hydroxy-3-dimethylbenzylphenyl-5-(1,1,3,3-tetramethylbutyl)]-2H-benzo triazole (commercially available as Tinuvin® 928); a mixture of poly(oxy-1,2-ethanediyl), α-[3-[3-(2H-benzotriazol-2-yl)-5-(1,1-dimethylethyl)-4-hydroxyphenyl]-1-oxopropyl]-omega-hydroxy and poly(oxy-1,2-ethanediyl), α-[3-[3-(2H-benzotriazol-2-yl)-5-(1,1-dimethylethyl)-4-hydroxyphenyl]-1-oxopropyl]-omega-[3-[3-(2H-benzotriazol-2-yl)-5-(1,1-dimethylethyl)-4-hydroxyphenyl]-1-oxopropyl]-(commercially available as Tinuvin® 1130 from Ciba); and 2-[4-[2-hydroxy-3-tridecyl oxypropyl]oxy]-2-hydroxyphenyl]-4,6-bis(2,4-dimethylphenyl)-1,3,5-triazine and 2-[4-[2-hydroxy-3-dodecyl oxypropyl]oxy]-2-hydroxyphenyl]-4,6-bis(2,4-dimethylphenyl)-1,3,5-triazine (commercially available as Tinuvin® 400 from Ciba). An example of a commercially available benzophenone UV stabilizer is 2-hydroxy-4-(N-octoxy)benzophenone (commercially available as Lowilite® 22 from Great Lakes Chemical Corp. of West Lafayette, Ind.).

Further examples of commercially available UV stabilizers that may be use in the present invention include, but are not limited to: p-methoxycinnamic acid 2-ethylhexyl ester stabilized with butylated hydroxy toluene (hereinafter "BHT") (commercially available as Uvinul MC 80 from BASF of Mount Olive, N.J.); p-methoxycinnamic acid 2-ethylhexyl ester unstabilized (commercially available as Uvinul MC 80 N from BASF); 2-cyano-3,3-diphenylacrylic acid 2'-ethylhexyl ester (commercially available as Uvinul 539 T from BASF); 2-hydroxy-4-(N-octoxy)benzophenone (commercially available as Cyasorb UV-501 from Cytec of West Paterson, N.J.); 2-(2'-hydroxy-3'-5'-di-t-amylphenyl) benzotriazole (commercially available as Cyasorb UV-2337 from Cytec); and 2-(2-hydroxy-5-t-octylphenyl)benzotriazole (commercially available as Cyasorb UV-5411 PA from Cytec).

A further class of UV stabilizers that may be used in the method of the present invention include those modified with at least one poly(oxyalkylene) chain. Such poly(oxyalkylene) chain modified UV stabilizers are characterized in having low migratory properties once imbibed (or diffused) into the plastic article (e.g., they are not easily leached out of the plastic article into which they have been imbibed). The poly(oxyalkylene) chain may be a homopolymer, copolymer or block-copolymer formed from the reaction of $C_2$–$C_{20}$ alkyelene oxides (e.g., ethylene oxide, propylene oxide and butylene oxide). The poly(oxyalkylene) group may be terminated with a hydroxyl group, a $C_1$–$C_{20}$ alkyl ether group, or a $C_1$–$C_{20}$ ester group. Poly(oxyalkylene) chain modified UV stabilizers are described, for example, in further detail in U.S. Pat. No. 6,602,447 B2.

Optical brighteners that may be included in the dye bath in the method of the present invention typically absorb a light wavelength of 450 nm or less and emit the light at a higher wavelength, such as a wavelength of 550 nm or less, preferably 525 nm or less. It is preferred that the emitted light be in the blue region of the visible spectrum (e.g., emitted light having a wavelength of at least about 400 nm and up to about 525 nm. Most preferably, the light emitted is no more than about 500 nm.

Classes of optical brighteners that may be used in the present invention include, but are not limited to benzoxazole derivatives and stilbene derivatives. Examples of commercially available benzoxazole derivatives that may be used in the present invention include, but are not limited to:

2,2'-(2,5-thiophenediyl)bis[5-tert-butylbenzoxazole] (commercially available as Uvitex® OB from Ciba); benzoxazole derivatives such as Blankophor® KLA (from Bayer of Pittsburgh, Pa.); Hostalux® KCB (from Clariant of Muttenz, Switzerland); and Hostalux® KCU (from Clariant). An example of a commercially available stilbene derivative is 4,4'-bis(2-benzoxazolyl)stilbene (commercially available as Eastobrite® OB-1 from Eastman of Kingsport, Tenn.). Further classes of optical brighteners that may be used in the present invention include, but are not limited to: derivatives of 4,4'-diminostilbene-2-2'-disulfonic acid; coumarin derivatives (e.g., 4-methyl-7-diethylaminocoumarin); and bis-(styryl)biphenyls.

Classes of mold release agents that may be included in the dye bath include, but are not limited to hydrocarbon-based mold release agents, fatty acid-based release agents, fatty acid amide-based mold release agents, alcohol-based mold release agents, fatty acid ester-based mold release agents, silicone-based mold release agents, and mixtures or combinations thereof. Examples of hydrocarbon-based mold release agents include, synthetic paraffins, polyethylene waxes and fluorocarbons. Fatty acid-based release agents that may be used include, for example, stearic acid and hydroxystearic acid. Fatty acid amide-based mold release agents that may be used include, for example, stearic acid amide, ethylenebisstearoamide and alkylenebisfatty acid amides. Examples of alcohol-based mold release agents include, stearyl alcohol, cetyl alcohol, and polyhydric alcohols such as polyglycols and polyglycerols. An example of a fatty acid ester-based mold release agent that may be included in the dye is butyl stearate.

Antistatic agents that may be included in the dye bath in the method of the present invention include, but are not limited to non-ionic antistatic agents, such as those containing fluorocarbon groups, and silicone oils, such as BAYSILONE O1 A (commercially available from Bayer AG, Germany). Further examples of antistatic agents that may be used in the present invention include, distearylhydroxylamine, triphenyl amine, tri-n-octylphosphine oxide, triphenyl phosphine oxide, pyridine N-oxide and ethoxylated sorbitan monolaurate.

Classes of thermal (or heat-resistant) stabilizers that may be included in the dye bath of the method of the present invention include, but are not limited to, phenol stabilizers, organic thioether stabilizers, organic phosphide stabilizers, hindered amine stabilizers, epoxy stabilizers and mixtures thereof. Specific examples of thermal stabilizers include, but are not limited to, 2,6-di-t-butyl-p-cresol, o-t-butyl-p-cresol, tetrakis-(methylene-3-(3,5-di-t-butyl-4-hydroxyphenyl)propionate)methane, β-naphtylamine, p-phenylenediamine, and thiodiethylene bis(3,5-di-tert-butyl)-4-hydroxyhydrocinnamate, which is commercially available from Ciba Specialty Chemical under the tradename IRGANOX 1035 thermal stabilizer.

Infra red (IR) absorbers that may be used in the method of the invention include dyes that absorb in the IR region of the spectrum. Examples of commercially available IR absorbers include, CYASORB IR-99, IR-126 and IR-165, which are available from Glendale Protective Technologies, Inc., Lakeland, Fla.

Antimicrobial agents that may be included in the dye bath in method of the present invention include, for example, substances having antimicrobial activity towards microorganisms, such as pathogenic microorganisms. The term "antimicrobial agents" as used herein and in the claims is also inclusive of antiseptic, disinfectant and antifungal substances. In addition, the antimicrobial agents may also be used in a pre-activated form, e.g., in a form that does not become antimicrobially active until the occurrence of a triggering event, such as action of a microbe on the pre-activated substance.

Examples of antimicrobial agents that may be included in the dye bath include, but are not limited to: quinolones, such as nalidixic acid, pipemidic acid, cinoxacin, ciprofloxacin, norfloxacin, ofloxacin, pefloxacin and enoxacin; aminoglycosides, such as gentamycin, kanamycin, amikacin, sisomycin, tobramycin and netilmicin; macrolides, such as erythromycin, clarithromycin and azithromycin; polypeptides, such as bacitracin, mupirocin, thyrothricin, gramicidin and tyrocidin; lincomycins, such as lincomycin and clindamycin; and antimycobacterial agents, such as rifampicin and fusidic acid. Further examples of antimicrobial agents that may be used in the dye bath include: 10,10'-oxybisphenoxy arsine; 2-n-octyl-4-isothiazolin-3-one; 2,4,4'-trichloro-2'-hydroxy diphenyl ether (also named 5-chloro-2-(2,4-dichlorophenoxy)phenol, and commonly referred to as Triclosan); N-butyl-1,2-benzisothiazolin-3-one; and N-(trichlorometh-ylthio)phthalamide.

The performance enhancing additives if used are typically present in the dye bath in a positive amount totaling less than or equal to 15 percent by weight, preferably less than or equal to 5 percent by weight, and more preferably less than or equal to 1 percent by weight. The performance enhancing additives are also typically present in the dye bath in an amount totaling at least 0.001 percent by weight, preferably at least 0.005 percent by weight, and more preferably at least 0.01 percent by weight. The performance enhancing additives may be present in the bath in a total amount ranging between any combination of these upper and lower values, inclusive of the recited values thereof. For example, the performance enhancing additives may be present in the dye bath in an amount typically totaling from 0.001 to 15 percent by weight, more typically from 0.005 to 5 percent by weight, and further typically in an amount of from 0.01 to 1 percent by weight. The percent weights being based on the total weight of the dye bath, in each case.

The method of the present invention involves dyeing a plastic article. The plastic article may comprise at least one polymer selected from thermoplastic and/or thermoset polymers. In an embodiment of the present invention, the plastic article comprises a polymer selected from at least one of (co)polyesters, (co)polycarbonates, polyesterpolycarbonate copolymers, acrylonitrile-butadiene-styrene (ABS) copolymers, polyamides, polyurethanes, polyalkyl(meth)acrylate (e.g., polymethylmethacrylate) and styrene copolymers (e.g., styrene acrylonitrile copolymers). The (co)polyesters, (co)polycarbonates, polyesterpolycarbonate copolymers may be aliphatic or aromatic polymers (e.g., containing residues of bisphenol A). These recited polymers may be thermoplastic polymers, thermoset polymers or a combination thereof, as the case may be.

As used herein and in the claims, the term "thermoplastic polymer" and similar terms means a polymer that has a softening or melting point, and is substantially free of a three dimensional crosslinked network resulting from the formation of covalent bonds between chemically reactive groups, e.g., active hydrogen groups and free isocyanate groups. Thermoplastic polymers that may be used in the present invention include those known to the skilled artisan, such as thermoplastic (co)polyesters, thermoplastic (co)polycarbonates, thermoplastic polyesterpolycarbonate copolymers, thermoplastic acrylonitrile-butadiene-styrene (ABS) copolymers, thermoplastic polyamides, thermoplastic polyurethanes, thermoplastic polyalkyl(meth)acrylate and thermoplastic styrene copolymers.

As used herein and in the claims the term "thermoset polymer" and similar terms means polymers having a three dimensional crosslinked network resulting from the formation of covalent bonds between chemically reactive groups (e.g., active hydrogen groups and free isocyanate groups or oxirane groups; or between unsaturated groups, such as allyl groups). Thermoset polymers typically do not have a melting point. Thermoset polymers that may be used in the present invention include those known to the skilled artisan, such as thermoset (co)polyesters, thermoset (co)polycarbonates, thermoset polyesterpolycarbonate copolymers, thermoset polyamides, thermoset polyurethanes, and thermoset polyalkyl(meth)acrylate.

Preferred thermoset polymers include thermoset polycarbonates. A preferred thermoset polycarbonate is a polymerizate of a polymerizable composition comprising polyol (allyl carbonate) monomers, e.g., CR-39 diethyleneglycol bis(allyl carbonate)monomer available commercially from PPG Industries, Inc.

The plastic article may contain additives that are known to the skilled artisan. Such additives include, but are not limited to: mold release agents; fillers; reinforcing agents in the form of fibers or flakes (e.g., metal flakes such as aluminum flakes); flame retardant agents; pigments; and opacifying agents, such as titanium dioxide; light-diffusing agents, such as polytetrafluoroethylene, zinc oxide, Paraloid EXL-5136 available from Rohm and Haas and crosslinked polymethylmethacrylate microspheres (such as n-licrospheres from Nagase America); UV-stabilizers; hydrolytic stabilizers; thermal stabilizers; and antimicrobial agents. In an embodiment, the plastic article contains at least one of pigments, crosslinked polymethylmethacrylate microspheres, glass microspheres and metal flakes.

The plastic article may be a molded plastic article, which is prepared by art-recognized methods. Molding methods include, for example compression molding, injection molding, rotational molding, extrusion, injection and extrusion blow molding, and casting. The molded plastic article may be selected from shaped articles, films (e.g., having a thickness of less than 30 mils (762 μm)), and sheets (e.g., having a thickness of greater than or equal to 30 mils (762 μm)). Examples of shaped molded articles include, optical lenses, ophthalmic lenses, sunshade lenses, face shields and glazings (e.g., windows in transportation vehicles, such as cars, trucks and aircraft, and windows in residential and commercial buildings). Further examples of molded plastic articles include: computer face-plates; keyboards; bezels and cellular phones; color coded packaging and containers of all types; residential and commercial lighting fixtures and components therefor; sheets, e.g., used in building and in construction; tableware, including plates, cups and eating utensils; small appliances and their components; as well as decorative films, including films that are intended for use in film insert molding.

In an embodiment of the present invention, the plastic article is selected from thermoplastic pellets and/or thermoplastic strands. Thermoplastic pellets and strands may be made by art-recognized methods, such as extrusion or melt-spinning. The thermoplastic pellets and/or strands are dyed, and then may be further processed. In an embodiment of the present invention, the dyed thermoplastic pellets and/or strands are melted (e.g., in an extruder) to form a molten dyed thermoplastic composition, and then the molten dyed thermoplastic composition is introduced (e.g., injected) into a mold. The contents of the mold are allowed to cool, the mold is opened, and a dyed shaped molded article is removed therefrom.

This method of further processing dyed thermoplastic pellets and/or strands is favorably differentiated from the direct incorporation methods described previously herein. With dyed thermoplastic pellets and/or strands, the dye is already present within the thermoplastic polymer (rather than being added to the polymer separately), which allows for more control and reliability with regard to producing molded articles having a desired and reproducible level of tinting.

In the method of the present invention, the plastic article to be tinted (e.g., a lens), is immersed at least partially in the dye bath for a period of time and at temperature at least sufficient to facilitate at least some impregnation (diffusion or imbibition), of the dye into the bulk of the plastic article thus effecting dyeing (or tinting) thereof. The time and temperature employed typically depends on the composition of the plastic article. Thermoset plastic articles are typically more resistant to heat (e.g., having a higher heat distortion temperature) than thermoplastic articles. As such, thermoset plastic articles can typically withstand immersion in dye baths at higher temperatures than thermoplastic articles.

Immersion times are typically less than or equal to 8 hours, more typically less than or equal to 4 hours, and even more typically less than or equal to 1 hour. Immersion times are also typically at least 5 seconds, more typically at least 30 seconds, and even more typically at least 1 minute. The immersion time may range between any of these upper and lower values, inclusive of the recited values. In an embodiment of the present invention, the immersion time is typically from 5 seconds to 8 hours, more typically from 15 or 30 seconds to 4 hours, and further typically from 1 minute to 1 hour (e.g., 1 to 15 minutes).

The temperature of the dye bath during immersion of the plastic article is typically at least room temperature (e.g., 25° C.) and less than the boiling and/or decomposition temperature of the dye bath. Typically the dye bath is maintained at a temperature of 25° C. to 99° C., for example from 60° C. to 97° C. or from 70° C. to 95° C. As described previously herein, the time and temperature of immersion will depend at least in part on the type of plastic article that is to be dyed. For example, with plastic articles of thermoplastic aromatic polycarbonate, dyeing may be efficiently carried out at a temperature of 90 to 99° C., with an immersion time of typically less than 1 hour, and more typically in the range of 1 to 15 minutes. In some instances the dye may be more quickly and efficiently imbibed into a softer plastic article, such as a softer thermoplastic article, in which case a lower dye bath temperature will typically suffice. For example, plastic articles fabricated from thermoplastic polyurethanes, or thermoplastic styrene-acrylonitrile copolymers (SAN's), may be readily dyed using the same dye bath composition used for tinting thermoplastic aromatic polycarbonate, but at temperatures of 60° C. and 80° C. respectively.

The tinted (or dyed) plastic article is then withdrawn from the dye bath. Withdrawal of the dyed plastic article from the dye bath may be performed quickly or at a slower rate (e.g., at a rate sufficient to effect a tinting gradient). When forming a dyed plastic article having a tinting gradient, the portion of the article that remains in the dye bath for a longer period of time is impregnated with more dye, and thus exhibits a greater degree of tinting (relative to those portions which were removed from the bath at an earlier time).

The dye bath may be prepared by mixing the dye, water, carrier, diol, optional surfactants and optional performance enhancing additives together in any order. For example the carrier and diol may be mixed together with the dye, and then this mixture is either added to water or water is added to it. In an embodiment, the dye bath is formed by: (i) preparing a mixture of water, carrier and diol; (ii) introducing the dye into a filter; and (iii) passing the mixture over the dye and through the filter, thereby forming the dye bath. The dye bath, or at least a portion thereof, is then typically passed continuously through the filter. Optionally, the mixture of water, carrier and diol may be heated, e.g., heated to a temperature of 25° C. to 99° C., or 60° C. to 97° C., or 70° C. to 95° C., and then the heated mixture is contacted with the dye in the filter.

The filter into which the dye is added, may be any suitable filter known to the skilled artisan. A preferred type of filter is a bag filter. Preparing and maintaining the dye bath in this manner, ensures that the level of dye in the bath is maintained substantially at a saturation level (as discussed previously herein). In addition, passing the dye bath continuously through the bag filter serves to remove particulate contaminants therefrom (e.g., unsolubilized dye particles), which could foul the dyed plastic articles prepared by immersion in the dye bath.

In a further embodiment, the dye bath is continuously introduced into and withdrawn from an immersion tank (or vessel). Typically, the immersion tank is part of a circuit which includes an inlet that is in fluid communication (via an inlet conduit) with a pump, which is in fluid communication with an outlet from the tank via an outlet conduit. The circuit may optionally include at least one filter, e.g., a bag filter as described previously herein, located inline with the inlet and/or outlet conduits. Preferably, the inlet and outlet of the immersion tank are positioned below the liquid level of the dye bath within the tank.

The immersion tank inlet may include a plate having a plurality of perforations (e.g., a diffuser or diffuser plate). Continuously introducing the dye bath into the immersion tank by passage through a plate having a plurality of perforations increases the level of turbulent mixing within the immersion tank, and improves the efficiency and uniformity of dyeing of plastic articles immersed therein. The perforations in the diffuser plate may have any suitable shape, e.g., circular, ellipsoid, polygonal or combinations thereof. The perforations of the diffuser plate typically have diameters of from 0.79 mm to 12.70 mm, e.g., from 3.17 mm to 6.35 mm. The diffuser plate may have any suitable configuration, e.g., it may be flat, concave or convex.

The scope of the method of the present invention is inclusive of additional steps whereby the composition of the dye bath is modified, e.g., such that an initial dye or dyes may be substituted with a subsequent dye or dyes. In an embodiment of the present invention, the dye and optional performance enhancing additives are separated from the other components of the dye bath (e.g., the water, carrier, diol and optional surfactants). Such a separation, is environmentally favorable in that it allows for re-use of the non-dye components of the bath, for example with another dye or dyes, or with a fresh dye(s), or as a rinse composition for rinsing dyed plastic articles removed from the dye bath. In addition, the dye separation method may be performed if the dye of the dye bath has been damaged, such as oxidized or otherwise denatured (e.g., due to over heating due to a temperature spike).

The dye separation process may be performed by contacting the dye bath with particulate activated carbon, and then isolating a substantially dye-free liquid therefrom containing water, carrier, diol and optional surfactants in substantially the same relative proportions as prior to the separation step. The dye-free liquid may then be mixed with another dye(s) to form a different dye bath. The dye bath may be contacted with the activated carbon by passing the dye bath continuously through a bed or column containing activated carbon.

The activated carbon typically retains substantially all of the dye of the dye bath, and preferably less than a minimal amount of the organic liquid components of the dye bath (e.g., carrier, diol and optional surfactants). However, there may be some evaporation of the organic liquid components, requiring adjustment of the dye-free liquid by means of subsequent additions of the evaporated components. It has been found that when the dye separation step is performed with a dye bath that contains dye, water, carrier and diol (in the absence of optional surfactants and optional performance enhancing additives), substantially none of the organic liquid components are retained on the activated carbon. This result is particularly surprising in that the use of activated carbon for the separation of organic compounds from aqueous compositions is known. As such, retention of both the dye and substantial amounts of the organic liquid components of the dye bath would be expected, but surprisingly is not observed in the present case.

In an embodiment of the present invention, the method further involves a dye separation process that includes:

(i) contacting the dye bath with particulate activated carbon to form a mixture of the dye bath and particulate activated carbon;

(ii) isolating, from the mixture, a dye-free liquid comprising water, carrier and diol; and (iii) optionally adding at least one dye to the dye-free liquid, thereby forming a further dye bath.

As discussed previously herein, the dye bath may be contacted with the particulate activated carbon by passing the dye bath through a bed or a column containing the particulate activated carbon. The dye-free liquid that is isolated in the dye separation process is substantially free of dye, e.g., containing an undetectable amount of dye as determined by means of spectrophotometric analysis. The particulate activated carbon typically has a 200 mesh particle size (e.g., a particle size of 0.075 mm). An example of a commercially available particulate activated carbon that may be used in the present invention is Filtrasorb 200 activated carbon from Calgon Carbon Corporation.

The amount of activated carbon that is required to effect dye separation is dependent in part on the temperature of the dye bath. In general, the amount of activated carbon required to effect dye separation is: reduced as the temperature of the dye bath is reduce; and increased as the temperature of the dye bath is increased. In an embodiment of the present invention, the dye bath is contacted with the activated carbon at a temperature of 25° C.

The dye(s) optionally added to the dye-free liquid may be selected from static dyes, photochromic dyes, and combinations thereof. The static dyes and photochromic dyes that may be added include those classes and examples described previously herein. The dye added to the dye-free liquid may be of the same type as the dye that was removed from the dye bath, in which case the further dye bath is a fresh or refreshed dye bath. Alternatively, the dye added to the dye-free liquid may be different than the dye that was removed from the dye bath, in which case the further dye bath is a new or different dye bath.

The dye separation process may further include adding additional materials to the dye-free liquid and/or the further dye bath. Such other additional materials include, for example, surfactants and/or performance enhancing additives, which may each be selected from those classes and examples as described previously herein.

Upon removal from the dye bath, the dyed plastic article is typically rinsed to remove excess dye bath material there from. The rinsing step is typically achieved by contacting at least a portion of the surface of the dyed article with a rinse composition comprising water, and optionally a carrier represented by formula I, and/or a diol. The water of the rinse composition may be deionized or distilled water. The carrier and diol that may be present in the rinse, composition are as described previously herein with reference to the dye bath, and may each be selected from those classes and examples as recited previously herein. For example, in an embodiment, the carrier is ethyleneglycol mono-butly ether, and the diol is diethylene glycol. Preferably, the rinse composition is composed of water, a carrier represented by formula I and a diol (as described previously herein with reference to diol (iv) of the dye bath).

The rinse composition may be contacted with the surface of the dyed plastic article by means of, for example, immersion (dipping), spray application and/or curtain application. After contact with the surface of the dyed plastic article, the rinse composition may be recycled and used to rinse additional dyed articles. After a number of rinse cycles, dye will typically accumulate in the recycled rinse composition. Accumulated dye may be removed from the recycled rinse composition by contacting the recycled rinse composition with particulate activated carbon, as described previously herein with regard to the dye separation process. Upon separating accumulated dye from the recycled rinse composition, the dye-free recycled rinse composition may then be used to rinse additional dyed articles.

The rinse composition typically contains water in an amount typically from 50 (or 51) to 100 percent by weight, more typically from 60 to 87 percent by weight, and further typically in an amount of from 65 to 75 percent by weight. The percent weights being based on the total weight of the rinse composition, in each case.

If present, the amounts of carrier and/or diol that may be present in the rinse composition may be selected from those ranges and amounts as recited previously herein with regard to the dye bath. For example, the carrier may be present in the rinse composition in an amount typically from 10 to 30 percent by weight, more typically from 15 to 25 percent by weight, and further typically in an amount of from 17 to 20 percent by weight. The percent weights being based on the total weight of the rinse composition, in each case. The diol may, for example, be present in the rinse composition in an amount of typically from 1 to 20 percent by weight, more typically from 5 to 15 percent by weight, and further typically in an amount of from 10 to 12 percent by weight. The percent weights being based on the total weight of the rinse composition, in each case.

After rinsing, the dyed plastic article is typically dried. Drying may be accomplished by wiping the rinsed dyed plastic article with a dry cloth, and/or by standing at room temperature (25° C.). Alternatively, the rinsed dyed plastic article may be dried by exposure to elevated temperatures (above 25° C.), e.g., at a temperature of from 50° C. to 100° C. In addition, warm air (e.g., having a temperature of 50° C. to 100° C.) may be passed over the surfaces of the rinsed dyed plastic article.

The present invention is more particularly described in the following examples, which are intended to be illustrative only, since numerous modifications and variations therein will be apparent to those skilled in the art. Unless otherwise specified, all parts and percentages are by weight.

EXAMPLES

In the following examples, each dye bath was prepared by mixing deionized water, carrier and diol together in a mixing tank, thus forming a liquid mixture having a total weight of 26,986 g. The liquid mixture was passed continuously at a temperature of 95° C. through a bag filter into which 50 grams of dye had been previously placed. The heated mixture containing dye was cycled from the mixing tank through the bag filter and back to the mixing tank for a period of time sufficient to saturate the mixture of water, carrier and diol with dye, and thus form the dye bath. The dye bath was recycled back to the mixing tank through small openings (having diameters of 4.8 mm) to enhance turbulent mixing of the dye bath during dyeing operations.

The initial cycling, for purposes of forming a saturated dye bath, was performed for a period of approximately 60 minutes. The dye bath was then continuously cycled through the above described system at a temperature of 95° C., and at a rate of 72 liters/minute.

In the following examples, the amount of dye in the dye bath is estimated to be a positive amount that is greater than zero and less than or equal to 0.1 percent by weight, based on the total weight of the dye bath (as calculated from the known weights of water, carrier, diol and dye used). Typically, a small amount of dye was observed to be present within the bag filter at the completion of each experiment. A dye bath was prepared as described above and contained 70 percent by weight of deionized water, 18 percent by weight of ethyleneglycol mono-butyl ether (as carrier) and 12 percent by weight of diethylene glycol (as diol), the percent weights being based on the total weight of deionized water, carrier and diol. This liquid mixture was passed through a bag filter into which 50 grams of MACROLEX Blue 3R dye was previously placed. After 60 minutes of cycling at 95° C., the dye bath was analyzed spectrophoto-metrically (at a temperature of 95° C.) and found to contain dye in an amount of 0.03 percent by weight, based on the total weight of the dye bath.

Examples 1–5

In the following examples, the levels of water and carrier were each modified, while the level of diol was maintained between 10 and 11 parts by weight. The dye used in each of examples 1–5 was MACROLEX Blue 3R dye, which was obtained commercially from Bayer Chemicals Corporation. The parts by weight of water, carrier and diol, based on 100 parts, for the dye bath compositions of examples 1–5 are summarized in the following Table 1.

TABLE 1

| Example | Water | Carrier[a] | Diol[b] |
|---|---|---|---|
| 1 | 77.8 | 11.1 | 11.1 |
| 2 | 73.7 | 15.8 | 10.5 |
| 3 | 70.0 | 20.0 | 10.0 |
| 4 | 65.0 | 25.0 | 10.0 |
| 5 | 60.0 | 30.0 | 10.0 |

[a]The carrier was ethyleneglycol mono-butyl ether.
[b]The diol used was diethylene glycol.

Clear test specimens of molded thermoplastic polycarbonate having dimensions of 5 cm×7.5 cm×0.25 cm were immersed in the dye bath for a period of 3 minutes. The thermoplastic polycarbonate used was MAKROLON 2600 homopolycarbonate, which is based on bisphenol A, having a MFR value of 10 to 12 g/10 minutes (as determined in accordance with ASTM D 1238), which is available commercially from Bayer Polymers LLC. Prior to dyeing, the test specimens had a percent light transmission of 90.6 percent, and a percent haze of 0.8 (each determined in accordance with ASTM D 1003). Upon removal from the dye bath, the dyed plastic articles were rinsed with methanol and deionized water, and hand:-dried with a soft cloth. The dyed plastic articles were observed in each case to be uniformly dyed. Physical properties of the dyed articles were measured and are summarized in the following Table 2.

TABLE 2

| Example | Percent Transmission[c] | Percent Haze[c] |
|---|---|---|
| 1 | 52.3 | 0.87 |
| 2 | 33.7 | 1.78 |
| 3 | 16.2 | 3.62 |
| 4 | 21.0 | 4.88 |
| 5 | 18.0 | 31.6 |

[c]Percent transmission and percent haze were each determined in accordance with ASTM D 1003.

The percent transmission and percent haze data of Table 2 were plotted as a function of the parts by weight of carrier, which is shown in FIG. 1. The data show that as the level of carrier is increased, percent transmission decreases, while percent haze increases. A desirable combination of both low percent light transmission and low percent haze is provided by dye baths containing 15 to 25 parts by weight of carrier.

Examples 6–11

In examples 6–11 the ratio of water to carrier was maintained in the range of 3.3 to 3.5, while the level of diol was modified. The dye used in each of examples 6–11 was MACROLEX Blue 3R dye, which was obtained commercially from Bayer Chemicals Corporation. The dye baths of examples 6–11 were prepared in substantially the same way and using the same equipment as with examples 1–5. The parts by weight of water, carrier and diol, based on 100 parts, for the dye bath compositions of examples 6–11 are summarized in the following Table 3.

TABLE 3

| Example | Water | Carrier[a] | Diol[b] |
|---|---|---|---|
| 6 | 75.7 | 21.6 | 2.7 |
| 7 | 73.7 | 21.1 | 5.3 |
| 8 | 71.8 | 20.5 | 7.7 |
| 9 | 70.0 | 20.0 | 10.0 |
| 10 | 68.5 | 20.0 | 12.5 |
| 11 | 65.0 | 20.0 | 15.0 |

Clear thermoplastic polycarbonate test specimens having the same dimensions, compositions and physical properties as those described in examples 1–5 were used. The clear thermoplastic polycarbonate test specimens were dyed under the same conditions as described in examples 1–5. The dyed plastic articles were observed in each case to be uniformly dyed. Physical properties of the dyed articles were measured and are summarized in the following Table 4.

TABLE 4

| Example | Percent Transmission[c] | Percent Haze[c] |
|---|---|---|
| 6 | 24.9 | 15.9 |
| 7 | 19.2 | 16.3 |
| 8 | 23.0 | 1.3 |
| 9 | 29.0 | 1.9 |
| 10 | 35.8 | 1.5 |
| 11 | 49.4 | 1.6 |

Figure 2:
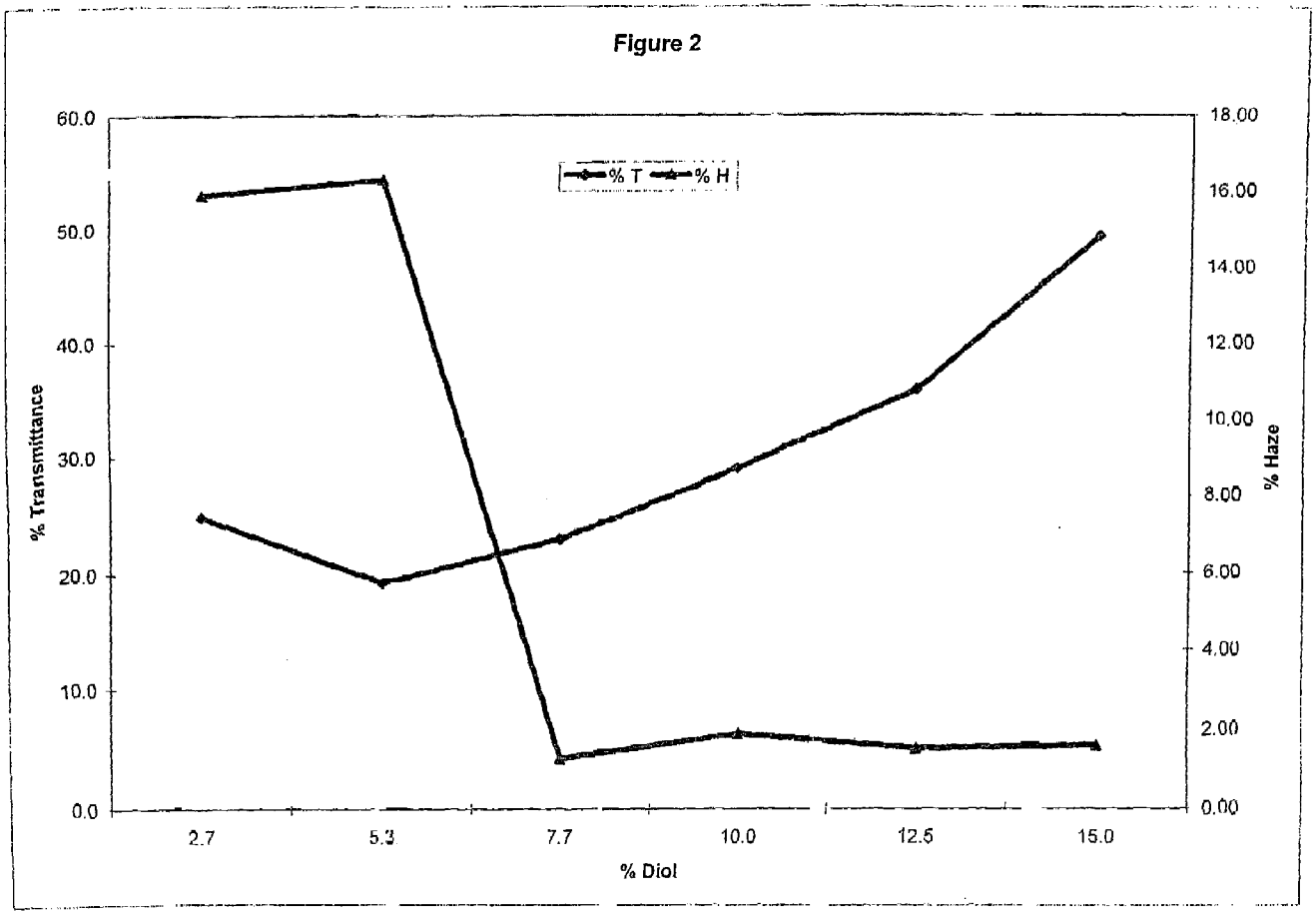
FIG. 2 is a graphical representation of a plot of percent light transmission (% T) and percent haze (% H) of dyed plastic articles as a function of the amount of diol present in the dye bath.

The percent transmission and percent haze data of Table 4 were plotted as a function of the parts by weight of diol, which is shown in FIG. 2. The data show that as the level of diol is increased, percent transmission increases, while percent haze decreases. An optimum combination of both low percent light transmission and low percent haze is provided by dye baths containing approximately 7 to 10 parts by weight of diol.

Dye baths containing water, diol and dye (in the absence of carrier) were observed to result in the formation of undyed thermoplastic polycarbonate articles. Dye baths containing water, carrier and dye (in the absence of diol) were observed to result in the formation of thermoplastic polycarbonate articles that were not uniformly dyed.

The present invention has been described with reference to specific details of particular embodiments thereof. It is not intended that such details be regarded as limitations upon the scope of the invention except insofar as and to the extent that they are included in the accompanying claims.

What is claimed is:

1. A method of dyeing a thermoplastic article selected from the group consisting of pellets and strands comprising:

(a) providing said thermoplastic article that includes at least one thermoplastic polymer;

(b) immersing at least a portion of said thermoplastic article in a dye bath comprising, (i) at least one dye, (ii) water, (iii) at least one carrier represented by the following general formula I, $$R—O—(CH_2)_n—OH \quad \text{I}$$

wherein R is a radical selected from linear or branched $C_1$–$C_{18}$ alkyl, benzyl, benzoyl and phenyl, and n is 2 or 3, and (iv) a diol selected from at least one of linear or branched $C_2$–$C_{20}$ aliphatic diols, poly($C_2$–$C_4$ alkylene glycol), cycloaliphatic diols having from 5 to 8 carbon atoms in the cyclic ring, monocyclic aromatic diols, bisphenols and hydrogenated bisphenols;

(c) retaining said portion of said thermoplastic article in said bath for a period of time at least sufficient to form a dyed thermoplastic plastic article;

(d) removing said dyed thermoplastic article from said bath; and (e)

(i) contacting said dye bath with particulate activated carbon to form a mixture of said dye bath and particulate activated carbon;

(ii) isolating from said mixture a dye-free liquid comprising water, said carrier and said diol; and (iii) optionally adding at least one dye to said dye-free liquid, thereby forming a further dye bath.

2. The method of claim 1 wherein said thermoplastic article comprises a polymer selected from at least one of (co)polyesters, (co)polycarbonates, polyesterpolycarbonate copolymers, acrylonitrile-butadiene-styrene copolymers, polyamides, polyurethanes, polyalkyl(meth)acrylate and styrene copolymers.

3. The method of claim 1 wherein said dye bath comprises, 0.00 1 to 0.5 percent by weight of said dye, 65 to 75 percent by weight of water, 15 to 25 percent by weight of said carrier, and 1 to 15 percent by weight of said diol, the percent weights being based on the total weight of said dye bath in each case.

4. The method of claim 1 wherein said dye bath is maintained at a temperature of 25 to 99° C.

5. The method of claim 1 wherein R is selected from linear or branched $C_1$–$C_{18}$ alkyl, and n is 2.

6. The method of claim 5 wherein R is selected from n-butyl, i-butyl and t-butyl.

7. The method of claim 1 wherein said dye bath further comprises a surfactant selected from at least one of: anionic surfactants; amphoteric surfactants; and a non-ionic surfactant selected from at least one of poly($C_2$–$C_4$ alkoxylated) $C_{14}$–$C_{18}$ unsaturated fatty acids, poly($C_2$–$C_4$ alkoxylated) phenol and poly($C_2$–$C_4$ alkoxylated) $C_1$–$C_9$ alkyl substituted phenol.

8. The method of claim 7 wherein said surfactant is present in an amount of from 1 to 15 percent by weight, based on the total weight of the dye bath.

9. The method of claim 1 wherein said diol is a poly ($C_2$–$C_4$ alkylene glycol) selected from diethylene glycol, triethylene glycol, tetraethylene glycol, pentaethylene glycol and mixtures thereof.

10. The method of claim 9 wherein said diol is diethylene glycol.

11. The method of claim 1 wherein said dye is selected from static dyes, photochromic dyes and combinations thereof.

12. The method of claim 11 wherein said dye is a water-insoluble static dye selected from the group consisting of azo dyes, diphenylamine dyes and anthraquinone dyes.

13. The method of claim 11 wherein said dye is a static dye, and said static dye is selected from the group consisting of disperse dyes, non-migratory static dyes and combinations thereof.

14. The method of claim 11 wherein said photochromic dye is selected from at least one of spiro(indoline)naphthoxazines, spiro(indoline)benoxazines, benzopyrans, naphthopyrans, organo-metal dithizonates, fulgides and fulgimides.

15. The method of claim 1 wherein said dye bath further comprises at least one of, UV stabilizers, optical brighteners, mold release agents, antistatic agents, thermal stabilizers, IR absorbers and antimicrobial agents.

16. The method of claim 1 wherein said thermoplastic article comprises at least one of pigments, crosslinked polymethylmethacrylate microspheres, glass microspheres and metal flakes.

17. The method of claim 1 wherein said thermoplastic polymer is a member selected from the group consisting of aromatic polycarbonates and aliphatic polycarbonates.

18. The method of claim 1 further comprising, melting at least one of said dyed thermoplastic pellets and said dyed thermoplastic strands to form a dyed molten thermoplastic composition, and introducing said dyed molten thermoplastic composition into a mold, thereby forming a dyed shaped molded article.

19. The method of claim 1 further comprising:

forming said dye bath by, (i) preparing a mixture of water, said carrier and said diol, (ii) introducing said dye into a filter, and (iii) passing said mixture over said dye and through said filter, thereby forming said dye bath; and passing continuously said dye bath through said filter.

20. The method of claim 1 further comprising, introducing continuously said dye bath into an immersion tank through a plate having a plurality of perforations.

21. The method of claim 1 further comprising contacting at least a portion of the surface of the dyed thermoplastic article removed from said dye bath with a rinse composition comprising water, and optionally at least one of said carrier and said diol.

* * * * *